US010431910B2

(12) United States Patent
Blineau et al.

(10) Patent No.: US 10,431,910 B2
(45) Date of Patent: Oct. 1, 2019

(54) ELECTRICAL CONNECTION DEVICE IN AN AIRCRAFT

(71) Applicant: SAFRAN ELECTRICAL & POWER, Blagnac (FR)

(72) Inventors: Jean Marc Blineau, Aussonne (FR); Frederic Colin, Plaisance du Touch (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 0 days.

(21) Appl. No.: 16/131,753

(22) Filed: Sep. 14, 2018

(65) Prior Publication Data

US 2019/0089075 A1 Mar. 21, 2019

(30) Foreign Application Priority Data

Sep. 15, 2017 (FR) ..... 17 58560

(51) Int. Cl.
*H01R 11/12* (2006.01)
*H01R 11/26* (2006.01)
(Continued)

(52) U.S. Cl.
CPC ..... *H01R 11/12* (2013.01); *H01R 4/28* (2013.01); *H01R 4/30* (2013.01); *H01R 4/38* (2013.01);
(Continued)

(58) Field of Classification Search
CPC ..... H01R 11/12
See application file for complete search history.

(56) References Cited

U.S. PATENT DOCUMENTS 4,575,295 A * 3/1986 Rebentisch ..... F16B 37/046 411/427
4,784,552 A * 11/1988 Rebentisch ..... F16B 37/046 403/348
(Continued)

FOREIGN PATENT DOCUMENTS

DE 196 24 662 A1 1/1997
DE 10 2012 006 663 A1 10/2013
(Continued)

OTHER PUBLICATIONS

French Preliminary Search Report dated May 9, 2018 in French Application 17 58560, filed on Sep. 15, 2017 (with English Translation of Categories of cited documents).

*Primary Examiner* — Ross N Gushi
(74) *Attorney, Agent, or Firm* — Oblon, McCelland, Maier & Neustadt, L.L.P.

(57) ABSTRACT

An electrical connection device including a support and an electrically conductive terminal lug, wherein the support includes a first face, with channels projecting from a second face opposite from the first face and defining between them a housing; the terminal lug includes a base for placing in the housing and a shank fastened coaxially to the base, the base including a first face from which the shank extends and a second face opposite from the first face for coming to bear against the second face of the support; the terminal lug including a locking ring having the shank passing through its center and movable in rotation relative to the shank, the ring including ramps extending from the outer periphery of the ring, the ramps co-operating with the channels.

5 Claims, 9 Drawing Sheets

(51) Int. Cl.

| | |
|---|---|
| ***H01R 4/30*** | (2006.01) |
| ***H01R 4/00*** | (2006.01) |
| ***H01R 4/38*** | (2006.01) |
| ***H01R 13/625*** | (2006.01) |
| ***H01R 4/28*** | (2006.01) |
| ***H01R 13/20*** | (2006.01) |
| *H01R 13/52* | (2006.01) |
| *H01R 11/11* | (2006.01) |

(52) U.S. Cl.
CPC ..... *H01R 4/54* (2013.01); *H01R 11/26* (2013.01); *H01R 13/20* (2013.01); *H01R 13/625* (2013.01); *H01R 11/11* (2013.01); *H01R 13/5202* (2013.01); *H01R 2201/26* (2013.01)

(56) References Cited

U.S. PATENT DOCUMENTS 4,840,525 A * 6/1989 Rebentisch ..... F16B 37/045 403/18
4,929,116 A * 5/1990 Mahl ..... A47B 43/02 403/263
5,655,865 A * 8/1997 Plank ..... E04D 3/08 411/85
5,931,690 A 8/1999 Sai et al.
5,947,518 A * 9/1999 Redman ..... F16B 37/044 280/781
6,059,156 A * 5/2000 Lehtinen ..... A45F 5/02 224/197
6,086,300 A * 7/2000 Frohlich ..... F16B 37/045 411/107
6,685,067 B2 * 2/2004 French ..... F41C 33/0227 224/192
6,827,531 B2 * 12/2004 Womack ..... B61D 45/001 410/104
6,929,226 B1 * 8/2005 Philistine ..... F16B 21/02 248/222.12
6,971,925 B1 12/2005 Orange
7,073,995 B2 * 7/2006 Herb ..... F16B 37/046 411/85
7,168,969 B1 * 1/2007 Wang ..... H01R 13/213 439/173
7,344,421 B1 * 3/2008 Spencer ..... H01R 11/282 439/286
7,381,059 B2 * 6/2008 Wong ..... H01R 35/04 439/131
7,462,776 B1 * 12/2008 Carpenter ..... H01R 3/08 174/40 CC
7,632,119 B1 * 12/2009 Ma ..... H01R 31/06 439/172
7,740,499 B1 * 6/2010 Willey ..... H01R 13/625 439/332
RE42,331 E * 5/2011 Carpenter, Jr. ..... H01R 3/08 174/40 CC
8,040,032 B2 * 10/2011 Kovacs ..... H01R 33/0809 313/318.01
8,109,704 B2 * 2/2012 Lewis ..... F01M 11/0408 411/111
8,146,227 B2 * 4/2012 Schmitz ..... B60R 5/003 224/486
8,353,649 B2 * 1/2013 Csik ..... F16B 37/045 411/108
8,579,656 B2 * 11/2013 Huang ..... H01R 35/04 439/171
8,608,502 B2 * 12/2013 Witter ..... H01R 13/6205 439/335
9,062,695 B2 * 6/2015 Witter ..... H01R 13/6205
9,360,039 B2 * 6/2016 Endt ..... F16B 37/044
9,365,150 B2 * 6/2016 Baldsiefen ..... B60P 7/0815
9,435,369 B2 * 9/2016 Deck ..... F16B 39/24
9,437,969 B2 * 9/2016 Witter ..... H01R 13/6205
9,876,310 B2 * 1/2018 Hashiguchi ..... H01R 13/6205
9,884,579 B2 * 2/2018 Baldsiefen ..... B60P 7/0815
10,109,963 B2 * 10/2018 Komoto ..... A41D 1/002
10,130,178 B1 * 11/2018 Landes ..... A47B 96/1466
2007/0183863 A1 * 8/2007 Blackaby ..... F16B 37/044 411/111
2010/0034612 A1 * 2/2010 Pau ..... F16B 37/044 411/108
2011/0130054 A1 6/2011 Lamoureux et al.
2011/0143595 A1 6/2011 Facco et al.
2014/0334896 A1 * 11/2014 Yang ..... F16B 37/042 411/166
2016/0294107 A1 10/2016 Trimborn
2019/0089075 A1 * 3/2019 Blineau ..... H01R 11/12
2019/0093695 A1 * 3/2019 Whalley ..... F16B 37/046

FOREIGN PATENT DOCUMENTS

DE 10 2013 204 832 A1 9/2014
DE 20 2016 100 256 U1 8/2016
WO WO 2004/084349 A2 9/2004
WO WO 2009/106581 A2 9/2009
WO WO 2010/012872 A1 2/2010

* cited by examiner

ELECTRICAL CONNECTION DEVICE IN AN AIRCRAFT

BACKGROUND OF THE INVENTION

The invention relates to an electrical connection device for fastening to an electrically conductive structure and for being electrically connected to an electric cable. An application of the invention may lie with interconnecting electrical return circuits, in particular on board aircraft.

In modern aircraft, more and more metal structures are being replaced by carbon and/or composite structures, in particular in the fuselage. In the past, the metal structures of aircraft provided the functional electrical return for electrical equipment by grounding the equipment, enabled the conductive housings of electrical equipment to be bonded, enabled all of the non-electrical metal parts to be set to the same potential, provided electromagnetic compatibility (EMC) protection for electrical installations, and served to convey direct or indirect currents due to lightning.

The structures made of carbon and/or composite materials that now replace metal structures present low electrical conductivity and are poor at withstanding heating produced by Joule effects. It thus becomes necessary in modern aircraft to provide a specific return circuit for electronic equipment, which circuit is made up of independent conductors that are electrically interconnected (e.g. conductive bars, strips, and/or cables). Such an additional return circuit is referred to as an all equipotential electrical network (ALEEN). Electrically interconnecting equipotential conductor elements of primary, secondary, and ALEEN networks then serves to form the equipotential electrical network of the aircraft.

It is known, in particular in the context of ALEEN networks, to couple electrical braids and/or cables electrically to electrically conductive structures by means of terminal lugs. In the present application, the term "electric cable" is used broadly to designate any electrical conductor capable of forming part of a wired electrical network.

FIG. 1 shows an example of an electrical connection device 100 commonly used in aircraft. An electric cable 10 is crimped in a terminal lug 11. The terminal lug 11 presents an annular conductive surface 12 that is to be held in contact with any electrically conductive structure 13, e.g. a metal surface of the aircraft. The surface of the structure 13 is protected by an insulating layer, with the exception of a surface that is made to be conductive. The surface that is to be made conductive is for coming into electrical contact with the bottom pad of the conductive surface 12 of the terminal lug 11. This electrical contact is held and/or locked by assembly means comprising a stud 14 (e.g. having a screw thread) passing perpendicularly through the electrically conductive structure 13, washers 16, and a nut 15. For the above-described assembly, the electric cable 10 and the terminal lug 11 lie in a common plane that is parallel to the plane of the electrically conductive structure 13 or that is inclined at about 15° relative thereto.

Nevertheless, making that type of electrical connection requires a relatively large number of operations: preparing the surface by removing the insulating surface from the structure 13 facing the bottom pad of the terminal lug 11, with such removable revealing the electrically conductive surface so as to guarantee good electrical conductivity, applying a varnish so as to guarantee good sealing of the contact zone between the terminal lug 11 and the surface that has been made electrically conductive, putting into place the bottom pad of the terminal lug 11 around the stud 14 passing through the electrically conductive structure 13, followed by the washer(s) 16, and then by the nut 15. That type of assembly also requires an appropriate tightening torque to be applied. Specifically, if the torque is not sufficient, then the quality of the electrical contact between the terminal lug 11 and the electrically conductive structure 13, which is coupled to the vibration of the aircraft, will lead to an increase in contact electrical resistance, leading to an undesired rise in temperature. Conversely, if the clamping is excessive, there is then a risk of the conductive material suffering creep, which is harmful to the quality of the electrical contact. Properly controlling the clamping torque requires special attention since the drawbacks that are associated therewith are generally not visible while the terminal lug 11 is being assembled, and they become apparent only later.

Furthermore, during assembly or maintenance of electrical connections, there is a risk of electrically conductive foreign bodies (e.g. assembly tools, screws, nuts) dropping, being lost, or forgotten in the aircraft. This risk can lead to two different electrical polarities being put into contact, thereby giving rise to a short circuit and an electric arc. Mitigating this risk therefore implies performing additional mandatory tasks, such as inspecting and regularly cleaning zones of the aircraft that are at risk. At present, making the above-described electrical connection involves significant preparation, assembly, measurement, and maintenance times.

OBJECT AND SUMMARY OF THE INVENTION

An object of the present invention is to remedy the above-mentioned drawbacks. More precisely, the present invention seeks in particular to facilitate making electrical connections between electric cables and electrically conductive structures, to reduce the time required for preparing and assembling such electrical connections, to reduce the number of assembly elements that are used, and to limit the risk of losing or forgetting electrically conductive foreign bodies.

In a first embodiment of the invention, this object is achieved by an electrical connection device formed by assembling a support that is to be fastened on an electrically conductive structure together with an electrically conductive terminal lug that is to be electrically connected to an electric cable, wherein:

- the support includes a first face that is to be in contact with said structure, with annular guide and locking channels projecting from a second face opposite from the first face, the channels extending in annular manner and defining a housing between them;
- the terminal lug comprising an annular base for placing in the housing and a tubular shank fastened coaxially to the base, the base including a first face from which the tubular shank extends and a second face opposite from the first face and for being brought to bear against the second face of the support when the base is present in the housing;
- the terminal lug further comprising a locking ring having the tubular shank passing through its center and movable in rotation relative to the tubular shank, the ring having annular ramps extending from the outer periphery of the ring, the annular ramps co-operating with the annular guide and locking channels of the support.

In an aspect of this first embodiment, each annular ramp of the locking ring may include a locking tooth that can be snap-fastened in a corresponding opening formed in an annular channel of the support, each opening being made in such a manner that at least one tooth of the ring, when snap-fastened in a corresponding opening, forms a visual indicator about a state of locking of the terminal lug against the support. Snap-fastening each tooth of the locking ring in a corresponding opening presents the advantage of reinforcing the locking of electrical contact between the terminal lug and the support. In addition, a tooth of the snap-fastened shape in a corresponding opening can be observed directly, thereby providing an indication that the terminal lug is properly locked against the support.

In a second embodiment of the invention, the above-mentioned object can be achieved by an electrical connection device formed by assembling together a support that is to be fastened on an electrically conductive structure and an electrically conductive terminal lug that is to be electrically connected to an electric cable, wherein:

the support includes a first face that is to be in contact with said structure, with at least two locking clips projecting from a second face of the support opposite from said first face, the clips defining between them a housing;

the terminal lug comprising an annular base for placing in the housing and a tubular shank fastened coaxially to the base, the base including a first face from which the tubular shank extends and a second face opposite from the first face and for coming into electrical contact with said structure, the base further including at least one catch extending over its circumference and co-operating with the locking clips of the support when the base is present in the housing of the support.

In an aspect of this second embodiment, the terminal lug may comprise a locking ring having the tubular shank passing through its center, the ring having tongues extending radially from its circumferential periphery, the support including projecting portions projecting from the second face of the support, the projecting portions including openings for co-operating with the tongues so that the locking ring holds the second face of the base in contact against the second face of the support and covers the locking clips. Each tongue of the locking ring snap-fastening by co-operating in an opening presents the advantage of reinforcing locking of the electrical contact between the terminal lug and the support. In addition, the tongues in the snap-fastened state can be observed directly through the openings, thereby providing an indication that the terminal lug is properly locked against the support.

In a third embodiment of the invention, the above-mentioned object can be achieved by an electrical connection device formed by assembling together a support that is to be fastened on an electrically conductive structure and an electrically conductive terminal lug that is to be electrically connected to an electric cable, wherein:

the support includes a first face that is to be in contact with said structure, with an elastically deformable shoe and at least one elastically deformable locking tongue, the shoe and said at least one tongue projecting from a second face opposite from the first face, the shoe and said at least one tongue defining between them a housing, the shoe and said at least one tongue extending towards the inside of the housing;

the terminal lug comprising an annular base for placing in the housing and a tubular shank fastened coaxially to the base, the base including a first face from which the tubular shank extends and a second face opposite from the first face and for being brought to bear directly against a face of the electrically conductive structure present in the housing of the support;

the shoe and said at least one tongue being configured to exert a force on the first face of the base that is suitable for holding the second face of the base in contact against the electrically conductive structure when the base is positioned in the housing.

In another aspect, the electrical connection device of any one of the three embodiments summarized above may include a sealing O-ring surrounding an electrically conductive surface forming all or part of the second face of the base of the terminal lug.

The use of an O-ring around an electrically conductive surface of the terminal lug presents the advantage of guaranteeing good sealing of the electrical contact between the conductive surface of the terminal lug and the support. Compared with the state of the art, it thus becomes possible to omit operations of removing insulation from the contacting faces of the terminal lug and of the support, and of applying a sealing varnish against the conductive face of the terminal lug in order to guarantee that the resulting assembly is sealed. This serves to reduce the time required for preparing the electrical connection device so that it can be assembled.

In a fourth embodiment of the invention, the above-specified object can be achieved by an electrical connection device formed by assembling together a support that is to be fastened on an electrically conductive structure and an electrically conductive terminal lug that is to be electrically connected to an electric cable, wherein:

the support comprises a plate having a first face that is to be in contact with said structure and an electrically conductive peg projecting from a second face of the plate opposite from the first face;

the terminal lug comprising a tubular shank presenting an end shaped to engage on the peg of the support, the tubular shank being configured to be elastically deformable when a force is applied against the tubular shank, and an eccentric lever configured to enable the terminal lug to be mechanically locked to the support by clamping the tubular shank when the tubular shank is engaged on the peg.

In an aspect of this fourth embodiment, the peg and the tubular shank may include visual indicators configured to indicate a state of the terminal lug being locked against the support. In particular, when the end of the tubular shank is engaged on the peg and the lever is exerting a clamping force on the tubular shank, the fact that the visual indicators are not visible serves to indicate that the electrical contact between the terminal lug and the support is properly locked.

In another aspect, for all of the above-described embodiments, the device may include permanent fastener means configured to enable the support of the device to be fastened to the electrically conductive structure.

The invention also provides an aircraft having an electrically conductive structure and at least one electrical connection device made in accordance with any of the above-summarized embodiments.

All of the above-described embodiments include in common the following advantages. As mentioned above, the traditional assembly shown in FIG. 1 leads to obtaining a cable that is crimped in a terminal lug that is arranged in a plane that is parallel to or inclined at 15° relative to an electrically conductive structure. Conversely, in all of the above-summarized embodiments, the terminal lug extends in a plane that is perpendicular to the electrically conductive structure. Thus, the longitudinal axis of the electric cable inserted in the terminal lug also presents a direction that is perpendicular to the electrically conductive structure. Unlike the prior art, the orientation of the electric cable no longer depends on a direction associated with screw-fastening the terminal lug to the electrically conductive structure. This makes it possible in particular to reduce mechanical stresses acting on the electric cable and makes it possible to benefit from an angle that can be chosen freely all about the longitudinal axis, thereby facilitating access to the electrical connection device, in particular during assembly and maintenance operations.

In addition, for all of the embodiments, the electrical connection device has a support that is to be assembled on the electrically conductive structure by using permanent fastener means such as rivets, while the terminal lug is made so as to be separable from the support. The terminal lug may be made separable from the support in particular by turning ramps in corresponding channels, by clip-fastening using corresponding locking clips, by engagement in a shoe, or indeed by clamping against a peg. Thus, all of the embodiments proposed serve to avoid the use of fastener means relying on screws, washers, and/or nuts. The above-summarized embodiments thus make it possible to avoid any risk of conductive foreign bodies being present in aircraft, and to avoid using assembly tools (screwdrivers, wrenches) for assembling the terminal lug with the electrically conductive face, and tightening operations that involve applying an appropriate torque. Assembly and maintenance of the electrical connection device are thus quicker and simpler.

BRIEF DESCRIPTION OF THE DRAWINGS

Other characteristics and advantages of the invention appear from the following description of particular embodiments of the invention, given as non-limiting examples, and with reference to the accompanying drawings, in which.

DETAILED DESCRIPTION OF EMBODIMENTS

Figure 1:
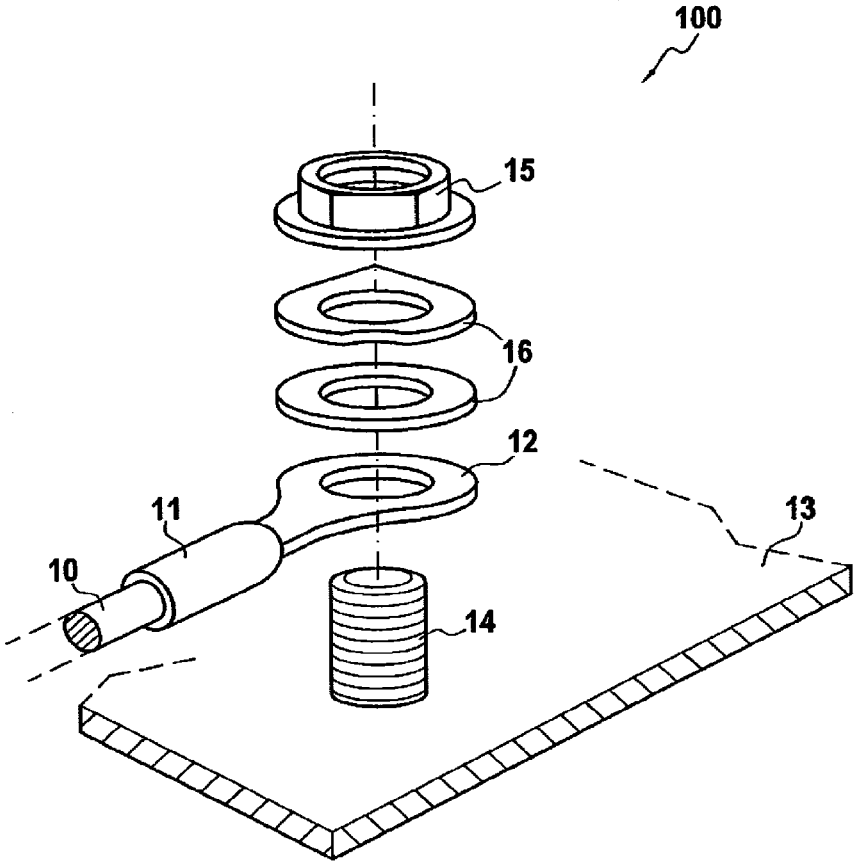
FIG.1 PRIOR ART
FIG. 1 is an exploded view of an electrical connection device known in the prior art.
Figure 2:
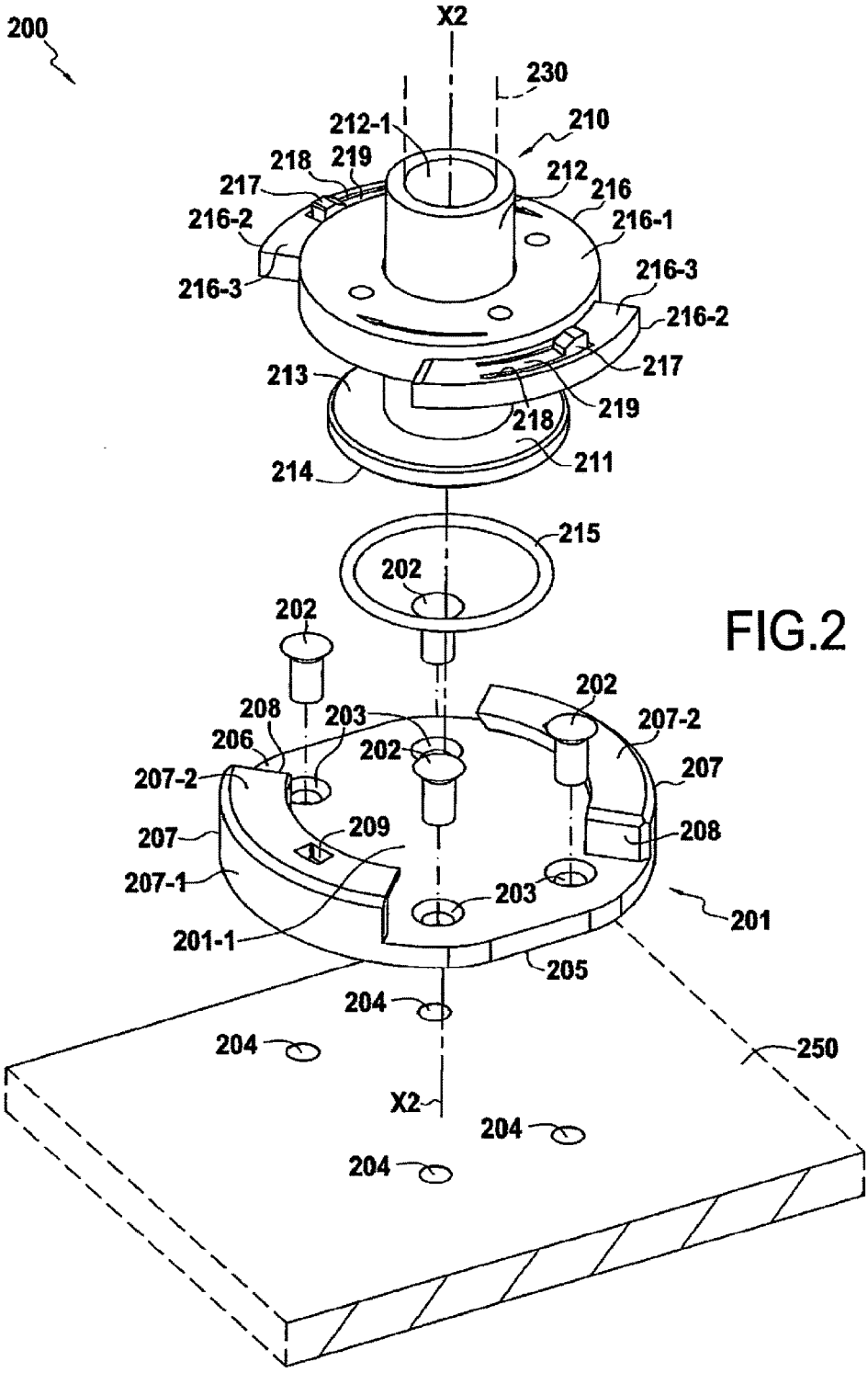
FIG. 2 is an exploded view of an electrical connection device in a first embodiment of the invention.

FIGS. 2 to 5 show an electrical connection device 200 in a first embodiment of the invention. In the example shown, the device 200 is centered relative to an axis of revolution X2 that is formed by a support 201 and by a terminal lug 210.

The support 201 is to be fastened to an electrically conductive structure 250, e.g. a metal structure of an aircraft. All or part of the support 201 is electrically conductive, in particular a bottom face of the support 201 that is to be fastened to the electrically conductive structure 250. The support 201 is fastened to the structure 250 by using permanent fastener elements 202, e.g. using rivets with countersunk or round heads, and passing in succession through fastener orifices 203, 204 formed respectively in the support 201 and the electrically conductive structure 250.

Below the term "bottom" is used to designate any face facing towards the structure 250, and the term "top" is used to designate any face facing away from the structure 250.

The support 201 has a first face 205 (bottom face) that is to come into contact with the structure 250, and a second face 206 opposite from the first face 205, i.e. a top face. Annular guide and locking channels 207 project from the second face 206 and extend in annular manner so as to define between them a housing 201-1.

In the example shown, the support 201 has two annular guide and locking channels 207. The channels 207 are curved in a first plane perpendicular to the axis X2 and thus present an upside-down L-shape in a second plane that is perpendicular to the first plane and that includes the axis X2, which L-shape extends from the second face 206 of the support 201 and has its free end extending towards the axis of revolution X2. More precisely, each channel 207 is formed by a first portion 207-1 perpendicular to a second portion 207-2. The first portion 207-1 projects from the second face 206 of the support 201, i.e. perpendicularly relative to the top face of the support 201, or in other words in a direction parallel to the axis X2. The second portion 207-2 projects from an end of the first portion 207-1 that is remote from the end of the first portion 207-1 that is secured to the top face of the support 201, and it extends orthogonally relative to the first portion 207-1. The second portion 207-2 thus extends in a plane parallel to the support 201. In a variant, the second portion 207-2 could be parallel to the support 201 in a radial direction of the support, i.e. in a direction extending between the first portion 207-1 of the channel 207 and the axis X2, without being parallel to the support 201 in a circumferential direction of the support 201, i.e. it could be contained in a plane presenting a non-zero angle relative to the support 201. Each annular channel 207 also has an abutment 208 at one circumferential end. The abutment 208 extends in a plane perpendicular to the support 201 to obstruct a space that exists between the second portion 207-2 of the channel 207 and the support 201, the abutment 208 extending along the first portion 207-1.

Various shapes may be envisaged for the support. By way of example, in FIGS. 2 and 3, the support 201 presents, in radial section, i.e. in a plane perpendicular to the axis of revolution X2, a profile that is substantially circular and from which surface portions have been removed between the annular channels 207 and outside the fastener orifices 203 (outside relative to the axis of revolution X2). The area occupied by the support 201 of the structure 250 is thus small, as is the weight of the support 201. Nevertheless, such an embodiment is not limiting, and by way of example the support 201 could present a shape that is perfectly circular in radial section.

The terminal lug 210 is electrically conductive and it is releasably connected relative to the support 201. The terminal lug 210 comprises an annular base 211 and a tubular shank 212 fastened coaxially to the base 211. The base 211 of the terminal lug 210 is for placing in the housing 201-1 defined by the annular guide and locking channels 207. The base 211 has a first face 213 (top face) from which the tubular shank 212 extends. The base 211 has a second face 214 opposite from the first face 213, i.e. a bottom face, that is to bear against the second face 206 of the support 201 when the base 211 is present in the housing 201-1 defined by the channels 207. All or part of the bottom face of the base 211 may be electrically conductive. By way of example, only a circular surface centered relative to the axis of revolution X2 of the terminal lug 210 and forming part of the second face 214 of the base 211 needs to be electrically conductive.

When a surface forming all or part of the second face 214 of the terminal lug 210 is electrically conductive, a sealing O-ring 215 may surround that surface so as to guarantee good sealing for the electrical contact between the conductive surface of the terminal lug 210 and the support 201. By way of example, the O-ring 215 is placed in a housing formed in the bottom face of the base 211 and around the electrically conductive surface of the base 211. Compared with the prior art, using such an O-ring 215 then presents the advantage of being able to omit operations of removing insulation from the bottom face of the terminal lug 210 and the top face of the support 201, or indeed of applying a sealing varnish on the conductive surface of the terminal lug 210. This serves to shorten preparation time prior to assembling the electrical connection device 200.

Furthermore, the tubular shank 212 of the terminal lug 210 enables the terminal lug 210 to be electrically connected to an electric cable 230 (shown in dashed lines) by inserting one end 230*a* of the electric cable 230 through a top orifice 212-1 of the tubular shank 212. The walls of the tubular shank 212 may be thin enough to be deformable so as to enable the tubular shank 212 to be crimped. Thus, when one end 230*a* of the electric cable 230 is engaged in the tubular shank 212, this end may be held firm in the tubular shank 212 by flattening and permanently deforming the walls of the tubular shank 212.

When the support 201 is fastened to the electrically conductive structure 250 and an electric cable 230 is engaged in the terminal lug 210, electrical connection between the electric cable 230 and the electrically conductive structure 250 relies on the terminal lug 210 being put into electrical contact against the support 201. Since the terminal lug 210 is removable relative to the support 201, it is possible to envisage various means for holding the terminal lug 210 against the support 201.

In the example shown, the terminal lug 210 has a locking ring 216 that serves, when the bottom face (second face 214) of the base 211 is bearing against the top face (first face 206) of the support 201, to lock the electrical contact between the terminal lug 210 and the support 201.

The locking ring 216 presents a central portion 216-1 of substantially annular shape with the tubular shank 212 passing through its center. The locking ring 216 is movable in translation along the tubular shank 212, along the axis X2 in the example shown. The central portion 216-1 of the locking ring 216 is made so as to be capable of being inserted in the housing 201-1 defined by the annular channels 207 of the support 201 and to cover the base 211 when the terminal lug 210 is assembled on the support 201. In other words, in a plane perpendicular to the axis X2, the central portion 216-1 of the locking ring 216 presents a radius that is smaller than the radius of the circle on which the annular channels 207 extend, and a radius greater than the radius of the base 211.

The locking ring 216 has annular ramps 216-2 extending from its outer periphery, the ramps 216-2 being arranged around the central portion 216-1. The annular ramps 216-2 are made in such a manner as to be capable of co-operating with the annular channels 207 of the support 201. In particular, the ramps 216-2 may be insertable and movable in rotation in a space that exists between the second portion 207-2 of the channel 207 and the support 201. Like the second portion 207-2 of the support 201, the ramps 216-2 may extend in a plane parallel to the support 201, or in a variant they may be contained in a plane presenting a non-zero angle relative to the support 201. There are as many ramps 216-2 as there are annular channels 207, i.e. two in the example shown, but a greater number of ramps 216-2 and annular channels 207 could be used.

The locking ring 216, formed by the central portion 216-1 and the ramps 216-2, is movable in rotation about the tubular shank 212. Turning the locking ring 216 then serves to control locking of the electrical contact that results from the terminal lug 210 bearing against the support 201.

When the terminal lug 210 bears against the support 201, the locking ring 216 can slide along the tubular shank 212 along the axis X2 so as to bear against the support 201. The central portion 216-1 of the ring then covers the base 211 of the terminal lug 210 and the ramps 216-2 come to bear against the support 201. Thereafter, controlling the locking of electrical contact between the terminal lug 210 and the support 201 by means of the locking ring 216 consists in turning the ramps 216-2, so as to vary the strength of engagement that results from engaging each ramp 216-2 of the locking ring 216 with a corresponding channel 207 of the support 201. For example, in an "unlocked" state, the ramps 216-2 are not engaged, or they are engaged in part only, in the space that exists between the second portion 207-2 of each channel 207 and the support 201. The strength of engagement between each channel 207 of the support and each corresponding ramp 216-2 of the ring is then not sufficient to guarantee that the electrical contact of the terminal lug 210 against the support 201 is locked, i.e. maintained. Progressively turning the locking ring 216 relative to the support 201 then enables the ramps 216-2 to co-operate progressively with the channels 207, thereby increasing the strength of engagement between them.

Figure 3:
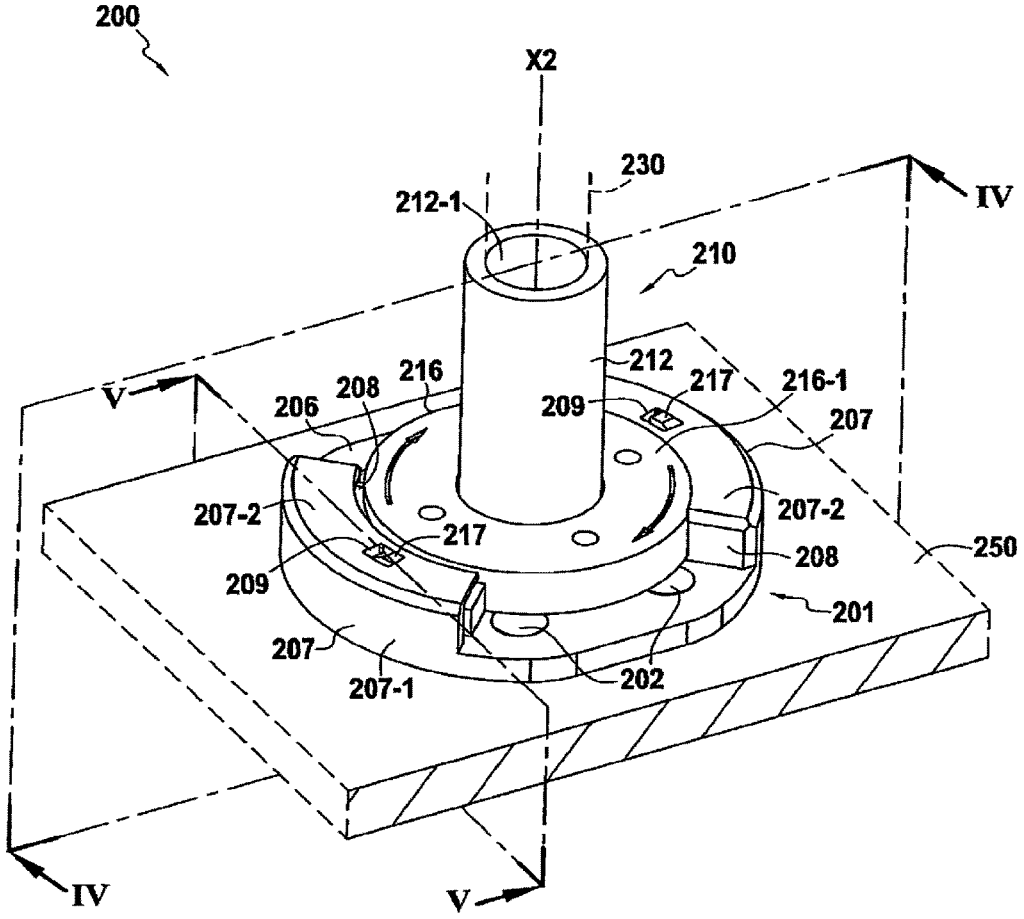
FIG. 3 is a perspective view of the FIG. 2 connection device.
Figure 4:
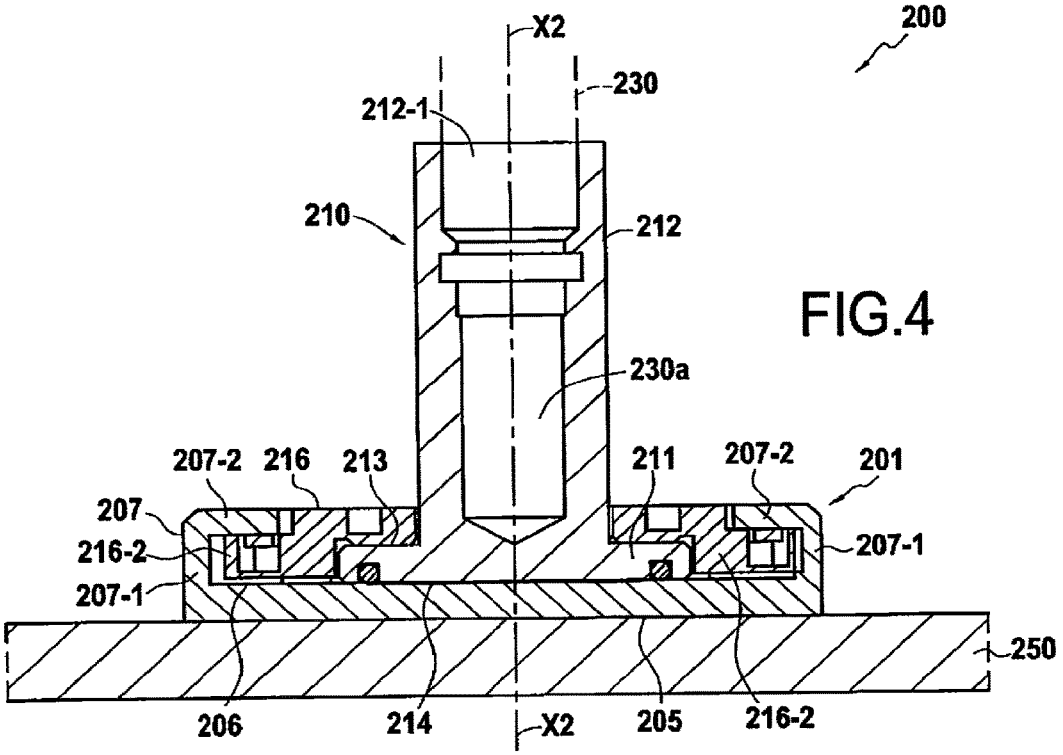
FIG. 4 is a section view of FIG. 3 on plane IV-IV.
Figure 5:
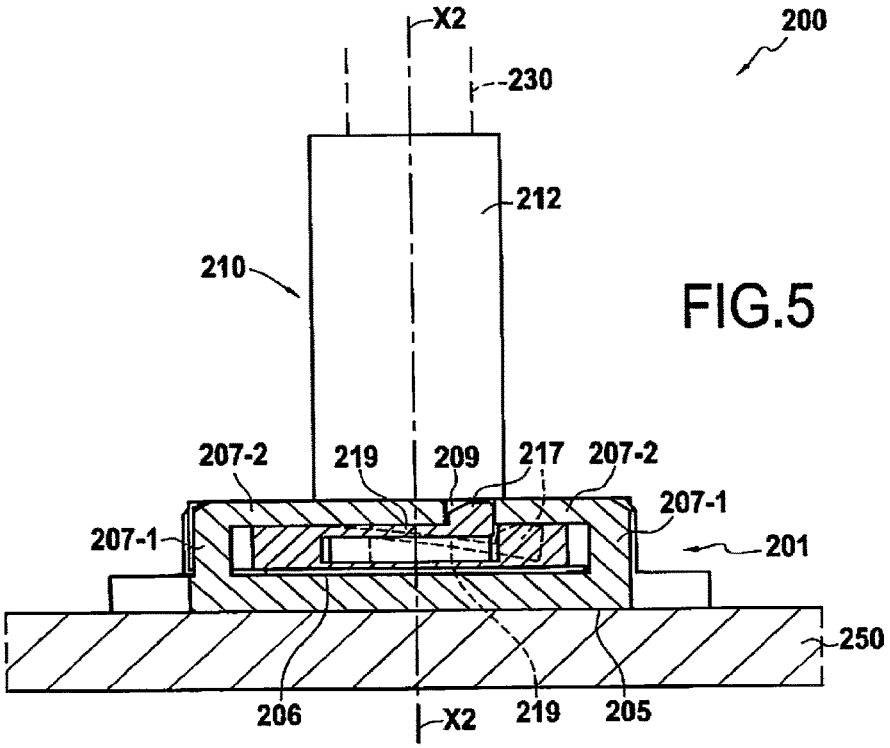
FIG. 5 is a section view of FIG. 3 on plane V-V.

The abutments 208 of the annular channels 207 are configured to limit turning of the locking ring 216 by coming into contact with the ramps 216-2. When the ramps 216-2 are turned to make contact with the abutments 208 of the annular channels 207, the strength of engagement of the annular channels 207 with the ramps 216-2 then serves to obtain a locking state suitable for maintaining electrical contact of the terminal lug 210 against the support 201. By way of example, turning of the locking ring 216 may be limited to one-fourth of a turn, i.e. 90° of angle, it being possible to envisage using other degrees of turning. An example of the electrical contact between the terminal lug 210 and the support 201 being in a locked state is shown in FIG. 3 after turning one-fourth of a turn. By way of illustrative example, in FIGS. 2 and 3, this locking is obtained by turning the locking ring 216 clockwise, with the direction of rotation needed for obtaining such locking being indicated to the user on the top face 216-2 of the locking ring 216. Electrical contact between the terminal lug 210 and the support 201 is unlocked merely by turning the locking ring 216 in the opposite direction, this unlocking potentially enabling the terminal lug 210 to be withdrawn after withdrawing the locking ring 216.

Furthermore, locking of the electrical contact between the terminal lug 210 and the support 201 can be reinforced by a snap-fastener system. By way of example, the top face 216-3 of each ramp 216-2 may carry a locking tooth 217 that projects from that face. For each tooth 217, an opening 209 for co-operating with the tooth 217 is arranged through the second portion 207-2 of a corresponding channel 207. Thus, when the electrical contact between the terminal lug 210 and the support 201 is in a locked state, each tooth 217 is snap-fastened in a corresponding opening 209 so as to reinforce the retention of the contact. In the example shown in FIGS. 2 to 5, each tooth 217 presents a chamfered shape in a plane parallel to the axis X2 so as to facilitate inserting the ramp 216-2 from which it projects into the corresponding channel 207.

Each ramp 216-2 may be made to be hollow, so as to enable a U-shaped slot 218 to be made around each tooth 217, the slot 218 being made through a top face 216-3 of the ramp 216-2 supporting the tooth 217. Providing such U-shaped slots 218 enables respective elastically deformable tongues 219 to be formed in the top face 216-3 of each channel 207, the tooth 217 being arranged on the tongue 219. Since the strength of engagement between a channel 207 and a ramp 216-2 varies while the locking ring 216 is being turned, providing elastically deformable tongues 219 thus serves to limit any risk of the teeth 217 preventing the locking ring 216 from turning before reaching the abutment 208. Thus, and as shown in dashed lines in FIG. 5, while the locking ring 216 is turning towards a locked state, each flexible tongue 219 flexes under the effect of pressure exerted by the second portion 207-2 of each channel 207 on each tooth 217. While the locking ring 216 is turning, when a ramp 216-2 comes into contact with an abutment 208, its tooth 217 comes into register with a corresponding opening 209 formed in the second portion 207-2 of the channel 207. The pressure exerted on the tooth 217 and thus indirectly on the tongue 219 then becomes zero. The flexible tongue 219 then returns to a rest state, i.e. a non-deformed state, and the tooth 217 snap-fastens into the opening 209, as shown by continuous lines in FIG. 5, thereby providing additional locking of the contact between the terminal lug 210 and the support 201. The snap-fastening of each tooth 217 in a corresponding opening 209 also serves to constitute a visual indication that the terminal lug 210 is in a locked state against the support 201. The snap-fastened state of the tooth 217 in the opening 209 is directly observable by a person assembling the locking ring 216 and thus provides an indication that the terminal lug 210 is properly locked against the support 201. Contact between the terminal lug 210 and the support 201 can be unlocked by applying pressure on the teeth 217 so as to disengage them from their openings 209, and then turning the locking ring 216 in the opposite direction.

Thus, the above-described first embodiment serves to guarantee good electrical contact between the support 201 and the terminal lug 210 merely by turning the locking ring 216. Such an embodiment is particularly advantageous compared with the prior art since it makes it possible to provide a terminal lug 210 that can be separated from the support 201, and that can be assembled quickly and easily by turning the locking ring 216. Furthermore, such an assembly does not require specific tools and fastener means (e.g. screws, screwdrivers, washers), thereby avoiding any risk of an electrically conductive foreign body being present in the electrical connection device 200.

Figure 6:
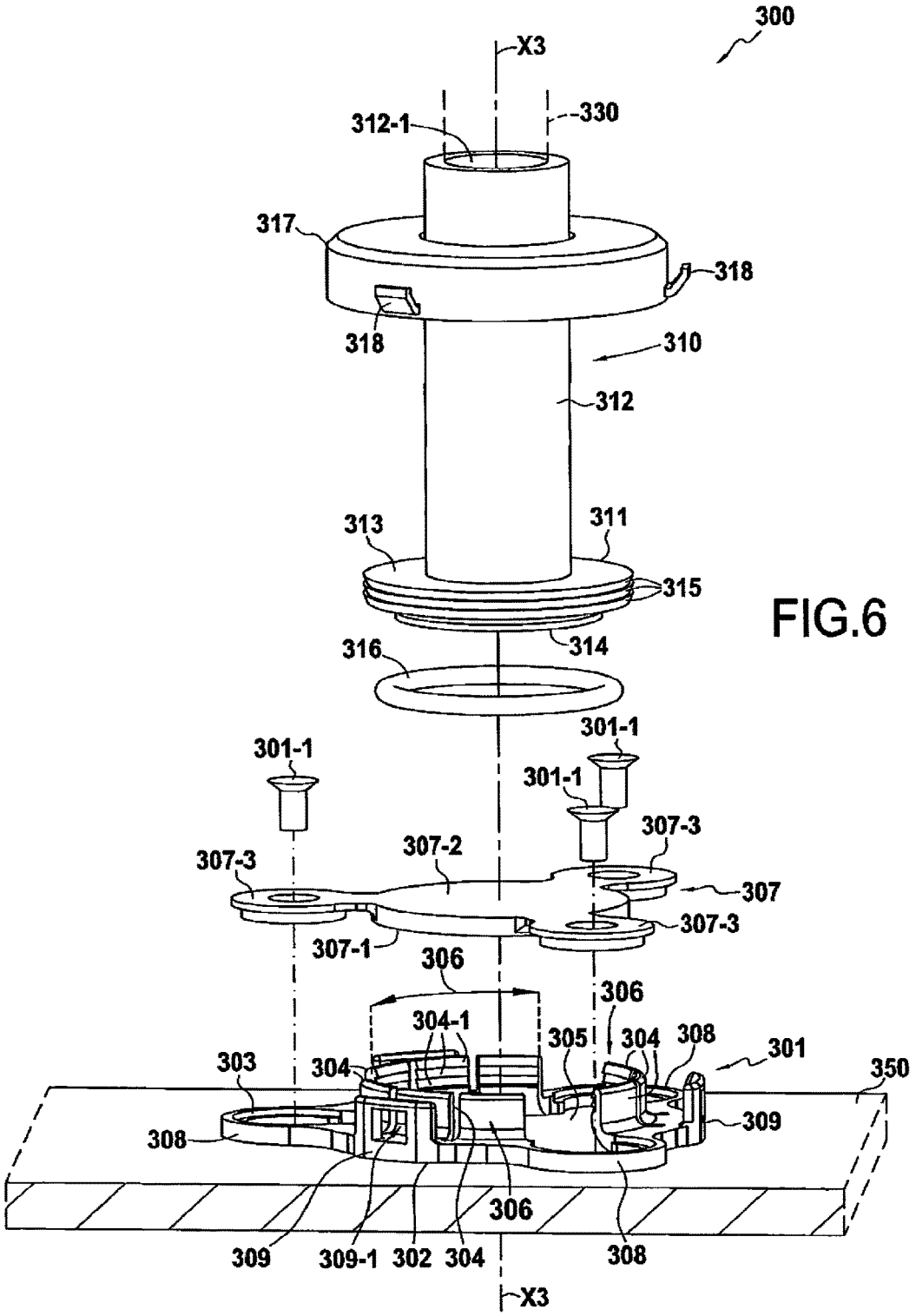
FIG. 6 is an exploded view of an electrical connection device in a second embodiment of the invention.
Figure 7:
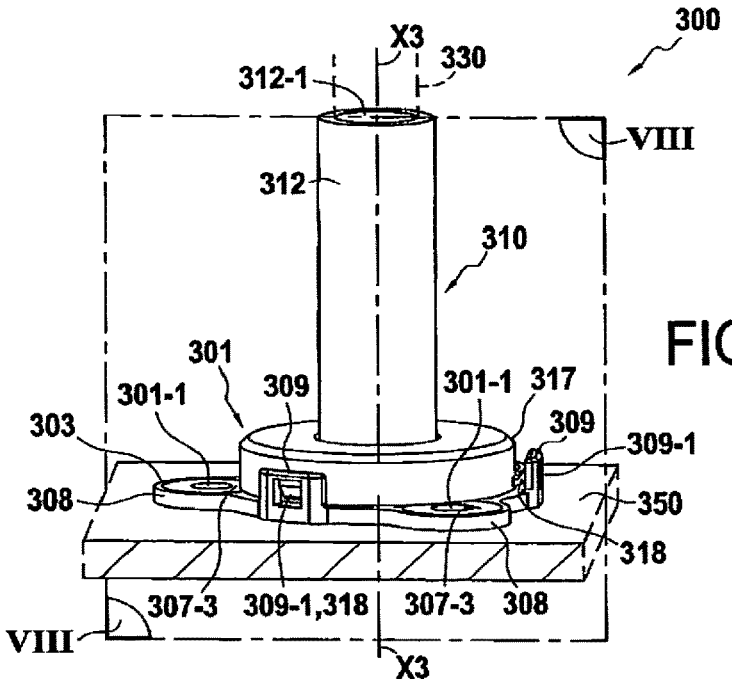
FIG. 7 is a perspective view of the FIG. 6 electrical connection device.
Figure 8:
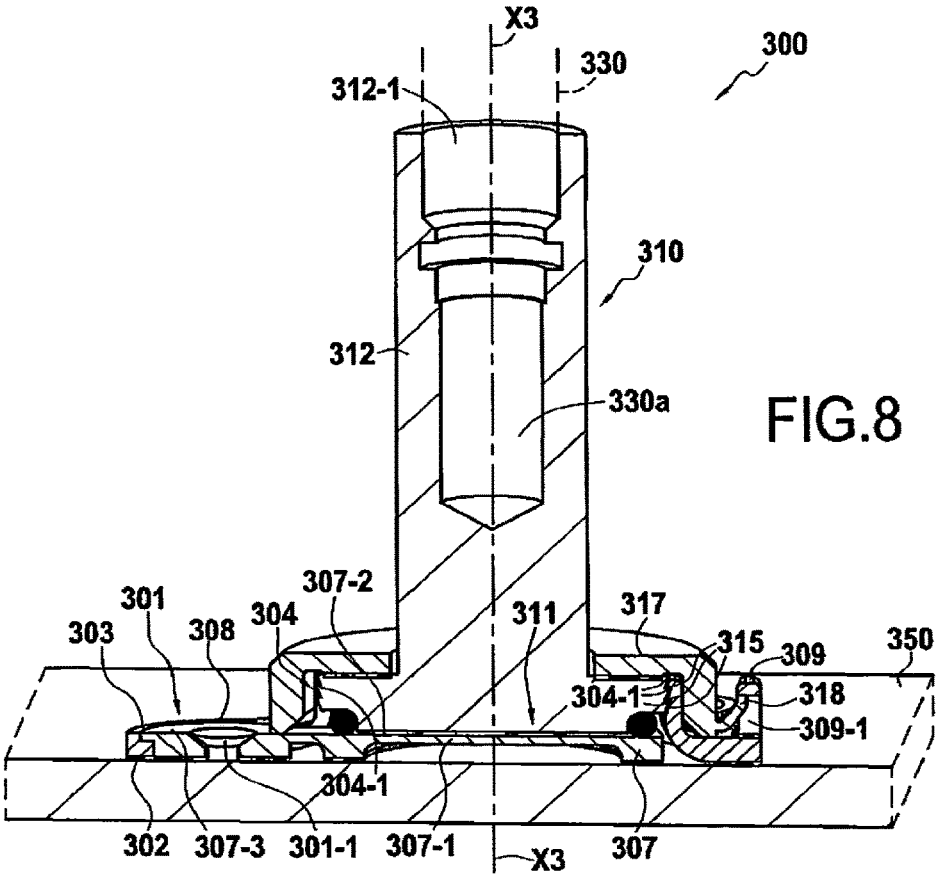
FIG. 8 is a section view of FIG. 7 on plane VIII-VIII.

FIGS. 6 to 8 show an electrical connection device 300 in a second embodiment of the invention. In the example shown, the device 300 is centered relative to an axis of revolution X3 and it is formed by a support 301 and a terminal lug 310, the support 301 being for fastening to an electrically conductive structure 350, e.g. a metal surface of an aircraft.

Below, the term "bottom" is used to designate any face facing towards the structure 350, and the term "top" is used to designate any face facing away from the structure 350.

The support 301 has a first face 302 (bottom face) that is to come into contact with the structure 350, and a second face 303 opposite from the first face 302, i.e. a top face. At least two locking clips 304 project from the second face 303 of the support 301 and define between them a housing 305 for receiving a bottom face of the terminal lug 310. In the example shown, the locking clips 304 are arranged in three sets 306 of three clips each. The sets 306 being regularly spaced apart from one another around a common circle in a plane perpendicular to the axis X3. The housing 305 as defined by the clips in this example is thus circular in shape in a plane perpendicular to the axis X3. Nevertheless, depending on the arrangement of the locking clips 304, the housing 305 could present any other shape, for example it could be rectangular in shape.

The locking clips 304 extend in a direction that is substantially parallel to the axis X3 and they present on inside faces facing the axis X3 one or more ribs for co-operating with one or more catches formed on the terminal lug 310. The locking clips 304 are for acting when the terminal lug 310 is positioned in the housing 305 to lock the electrical contact existing between the terminal lug 310 and the electrically conductive support 350. The electrical contact between the terminal lug 310 and the structure 350 may be direct or indirect. In a first example that is not shown, when the terminal lug 310 is positioned in the housing 305 of the support 301, the bottom face of the terminal lug 310 is in direct contact with a surface of the structure 350. In another example, as shown herein, the support 301 has an electrically conductive plate 307 molded on the support 301. The plate 307 presents a bottom face 307-1 for coming directly into contact with the structure 350 when the support 301 is assembled on the structure 350, and a top face 307-2 for coming directly into contact with the bottom face of the terminal lug 310 when it is positioned in the housing 305. Using the plate 307 can thus serve to further improve the electrical connection between the terminal lug 310 and the support 301 when the terminal lug 310 is inserted in the housing 305. All or part of the support 301, with or without the plate 307, may be electrically conductive, but that is not essential. The support 301 without the plate 307 may be made of composite material, for example.

The support 301 also has fastener tabs 308 extending in a plane perpendicular to the axis X3 away from the housing 305, i.e. in a radial direction going away from the axis X3. In the example shown in FIG. 6, the tabs 308 extend outwards from the housing 305 starting from each of the spaces between the sets 306 of clips, such that three tabs 308 are provided in this example. The plate 307 may also have fastener tabs 307-3 molded on the tabs 308 of the support 301. The support 301 is then fastened on the structure 350 using permanent fastener elements 301-1, e.g. rivets with countersunk or round heads, suitable for passing in succession through the fastener tabs 307-3, 308 of the plate 307 and of the support 301, or solely through the tabs 308 of the support 301 (when there is no plate 307), being inserted in corresponding holes formed in the electrically conductive structure 350.

The terminal lug 310 is electrically conductive and it is made to be separable from the support 301. The terminal lug 310 is constituted by an annular base 311 and a tubular shank 312 fastened coaxially to the base 311. The base 311 of the terminal lug 310 is for placing in the housing 305 defined by the locking clips 304.

The base 311 has a first face 313 (top face) from which the tubular shank 312 extends. The base has a second face 314 opposite from the first face 313, i.e. a bottom face, that is to establish electrical contact with the electrically conductive structure 350 when the base 311 is present in the housing 305 of the support 301. Electrical contact may be direct as a result of the second face 314 being caused to bear against the structure 350 (in the absence of the plate 307), or indirect if the second face 314 is caused to bear against the plate 307.

The base 311 also has at least one catch 315 extending around its circumference, the catch 315 being designed to co-operate with the locking clips 304 of the support. Thus, when the base 311 of the terminal lug 310 is put into the housing 305, said at least one catch 315 co-operates with the locking clips 304 so as to maintain electrical contact between the terminal lug 310 and the structure 350. Electrical contact between the terminal lug 310 and the electrically conductive structure 350 is thus locked merely by clipping the base 311 in the housing 305. In the example shown in FIGS. 6 and 8, the base 311 has three circumferential catches 315, but it is possible to envisage any other number of catches. In order to strengthen co-operation between the catches 315 and the locking clips 304 so as to improve clip-fastening retention, the catches 315 may optionally be chamfered so as to present a barbed shape, like the catches 315 shown in FIG. 8.

All or part of the second face 314 of the base 311 may be electrically conductive. In the example shown, all of the surface of the second face 314 (bottom face) of the base 311 is electrically conductive. A sealing O-ring 316 can then surround the electrically conductive surface of the second face 314, i.e. its entire surface in this example. As in the first embodiment, using an O-ring 316 presents the advantage of being able to omit operations of removing insulation from the bottom face of the terminal lug 310 and from the top face of the support 301, or indeed of applying a sealing varnish on the conductive surface of the terminal lug 310.

Furthermore, as in the first embodiment, the tubular shank 312 of the terminal lug 310 enables the terminal lug 310 to be electrically connected to an electric cable 330 (shown in dashed lines) by inserting an end 330*a* of the electric cable 330 through a top orifice 312-1 of the tubular shank 312. Once more, the walls of the tubular shank 312 may be deformable in order to enable the walls to be crimped so as to hold the electric cable 330 that is engaged in the tubular shank 312.

When the support 301 is fastened to the electrically conductive structure 350 and an electric cable 330 is engaged in the terminal lug 310, the electrical connection between the electric cable 330 and the electrically conductive structure 350 relies on the terminal lug 310 being put into (direct or indirect) electrical contact with the surface 350. As described above, this electrical contact can be maintained by clip-fastening as a result of the co-operation between at least one catch 315 of the base 311 of the terminal lug 310 with the locking clips 304 of the support 301. Maintenance of this electrical contact can be further reinforced using additional locking means.

In the example shown, the terminal lug 310 has a locking ring 317 for use, when the bottom face (second face 314) of the base 311 is bearing against the top face (first face 306) of the support 301 to provide additional locking of the electrical contact between the terminal lug 310 and the structure 350.

The locking ring 317 has the tubular shank 312 passing through its center and it includes tongues 318 in a plane perpendicular to the axis X3, the tongues extending radially from the circumferential periphery of the ring. The tongues 318 are made so as to be suitable for snap-fastening in corresponding openings in the support 301 and they may be elastically deformable. Thus, the support 301 also has portions 309 that project from its second face 303 in a direction perpendicular to the support 301, i.e. along the axis X3, the portions 309 having openings 309-1 configured to co-operate with the tongues 318 of the locking ring 317. In the example shown, the tongues 318 present a hooked shape in a plane containing the axis X3, i.e. they have a shape in the form of one-fourth of a circle extending away from the support 301. Giving the tongues 318 this direction then enables good fastening to be imparted to the locking ring 317 when the tongues 318 are snap-fastened in the openings 309-1 of the support 301. In order to enable the tongues 318 of the ring to snap-fasten in the openings 309-1, the ring is movable in translation along the tubular shank 312 along the axis X3 and presents a hollow bottom face that is made so as to be capable of covering the set of locking clips 304. Thus, when the electrical contact between the terminal lug 310 and the structure 350 is in a locked state, the base 311 of the terminal lug 310 is clipped by means of its catches 315 between the locking clips 304 of the support 301. The locking ring 317 then bears against the top face of the base 311 and the tongues 318 of the ring snap-fasten in the opening 309-1 of the support 301.

The snap-fastening of each tongue 318 in a corresponding opening 309-1 also serves to provide a visual indication about the locking state of the electrical contact between the terminal lug 310 and the electrically conductive structure 350. The snap-fastened state of a tongue 318 in an opening 309-1 can be observed directly by a person in charge of assembling the locking ring 317 and thus provides an indication that the terminal lug 310 is properly locked to the structure 350.

Thus, the second above-described embodiment serves to guarantee good electrical contact between the structure 350 and the terminal lug 310, merely by clipping the terminal lug 310 in a housing 305 provided in the support 301. This fastening of the terminal lug 310 is releasable and it may be accompanied by the tongues 318 of the locking ring 317 snap-fastening in the opening 309-1 of the support 301, thereby improving the locking of the electrical contact. In comparison with the state of the art, such an embodiment thus serves once more to provide a terminal lug 310 that is separable from the support 301, and that can be assembled quickly and easily on the support 301 via a system of clips and snap-fastener tongues. Such an assembly does not require specific tools and fastener means, thereby avoiding any risk of conductive foreign bodies being present in the electrical connection device 300.

Figure 9:
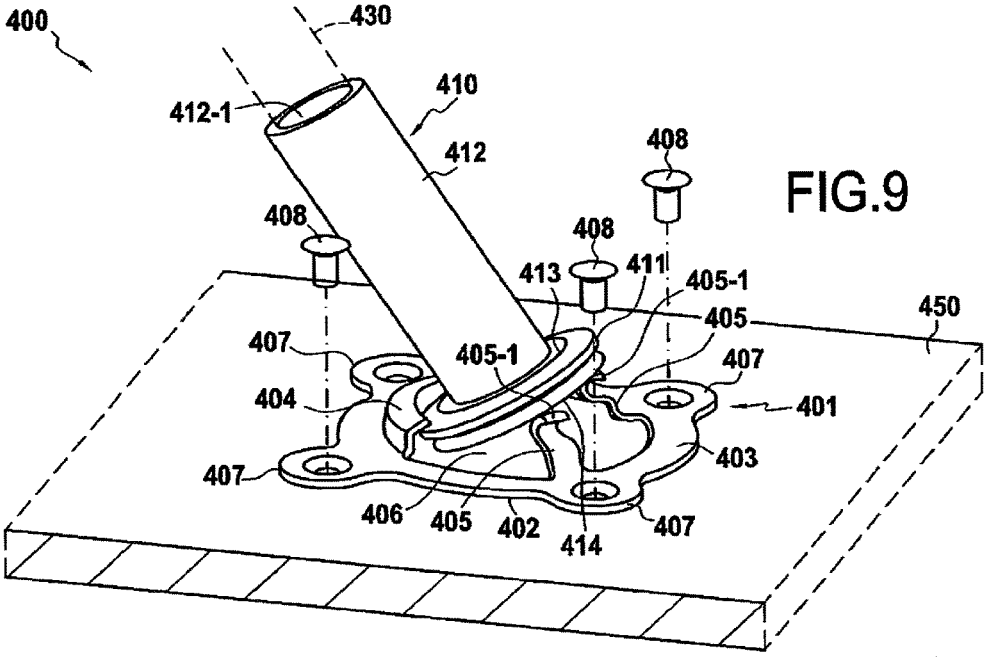
FIG. 9 is an exploded view of an electrical connection device in a third embodiment of the invention.
Figure 10:
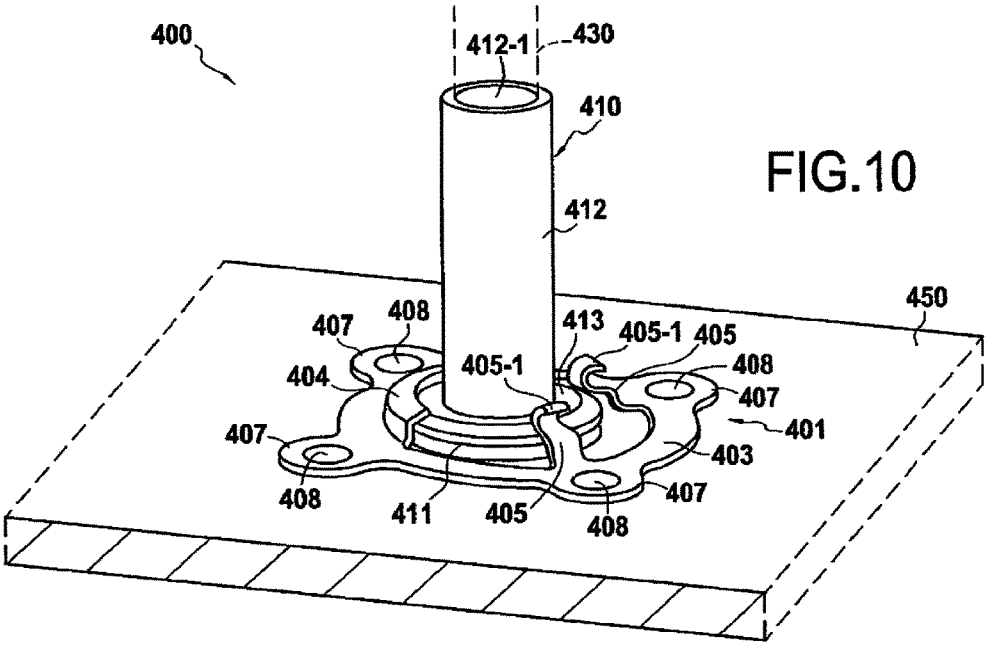
FIG. 10 is a perspective view of the FIG. 9 electrical connection device.

FIGS. 9 and 10 show an electrical connection device 400 in a third embodiment of the invention. The device 400 is constituted by a support 401 and a terminal lug 410, the support 401 being for fastening on an electrically conductive structure 450, e.g. a metal surface of an aircraft.

Below the term "bottom" is used to designate any face facing towards the structure 450, and the term "top" is used to designate any face facing away from the structure 450.

The support 401 has a first face 402 (bottom face) that is to come into contact with the structure 450, and a second face 403 opposite from the first face 402, i.e. a top face. An elastically deformable shoe 404 and at least one elastically deformable locking tongue 405 project from the second face 403, defining between them a housing 406, and they extend towards the inside of the housing 406. In the example shown, the support 401 has two locking tongues 405 projecting from the top face of the support 401.

The support 401 also has fastener tabs 407, there being four in the example shown, that extend outwards from the housing 406. The support 401 can then be fastened on the structure 450 via permanent fastener elements 408, such as countersunk or round headed rivets passing through the fastener tabs 407 so as to be inserted in corresponding holes formed in the structure 450.

The terminal lug 410 is electrically conductive and it is releasably connected relative to the support 401. The terminal lug 410 is constituted by an annular base 411 and a tubular shank 412 fastened coaxially to the base 411. The base 411 of the terminal lug 410 is for placing in the housing 406 defined by the shoe 404 and the locking tongues 405. The base 411 has a first face 413 (top face) from which the tubular shank 412 extends. The base 411 has a second face 414 opposite from the first face 413, i.e. a bottom face that is to establish electrical contact with the electrically conductive structure 450 by being caused to bear directly against the surface of the structure 450.

All or part of the second face 414 of the base 411 may be electrically conductive. In the example shown, all of the surface of the second face 414 of the base 411 is electrically conductive. A sealing O-ring (not shown) may then surround the electrically conductive surface of the second face 414. Using such an O-ring presents the advantage of being able to avoid operations of removing insulation from the bottom face of the base 411 of the terminal lug 410 and from the top face of the electrically conductive structure 450, or indeed operations of applying a sealing varnish to the conductive surface of the base 411.

Furthermore, the tubular shank 412 of the terminal lug 410 enables the terminal lug 410 to be electrically connected to an electric cable 430 (shown in dashed lines) by inserting an end of the cable into a top orifice 412-1 of the tubular shank 412. The walls of the tubular shank 412 may be deformable so as to enable the electric cable 430 engaged in the tubular shank 412 to be held by crimping the walls.

When the support 401 is fastened on the electrically conductive structure 450 and an electric cable 430 is engaged in the terminal lug 410, the electrical connection between the electric cable 430 and the electrically conductive structure 450 relies on the terminal lug 410 being put (directly) into electrical contact against the surface 450. This electrical contact occurs when the base 411 of the terminal lug 410 is inserted in the housing 406, and it is maintained by the shoe 404 and the locking tongues 405.

By way of example, the shoe 404 may present a profile in the form of one-fourth of a circle in a plane that contains the support 401, and an upside-down L-shape in a plane perpendicular to the plane containing the support 401, the upside-down L-shape extending towards the inside of the housing 404 of the support 401. This upside-down L-shape is provided so as to be able to co-operate with the base 411 of the terminal lug 410 when the terminal lug is in position in the housing 406 and to be capable of exerting a spring force on the top face of the base 411. When the support 401 is fastened to the structure 450 and the terminal lug 410 is in position in the housing 406, the shoe 404 then exerts a spring force on the base 411 that is directed towards the electrically conductive surface 450, thereby maintaining the electrical contact of the base 411 against the structure 450.

The electrical contact is further maintained by the locking tongues 414 exerting a spring force on the top face of the base 411 towards the electrically conductive structure 450. In the example shown, the locking tongues 405 extend towards the inside of the housing 406, and at their ends 405-1, they present respective C-shaped profiles facing towards the outside of the housing 406 in planes perpendicular to the plane containing the support 401. These C-shaped ends are configured to facilitate inserting the base 411 of the terminal lug 410 into the housing 406 and to bear against the top face of the base 411 when the terminal lug 410 is in position in the housing 406.

The terminal lug 410 can thus be inserted in the housing 406 of the support 401 in two steps. In a first step, shown in FIG. 9, a portion of the base 411 of the terminal lug 410 is positioned between the shoe 404 and the housing 406, while another portion of the base 411 is positioned to bear down on the ends 405-1 of the tongues. In this step, the axis of revolution of the terminal lug 410 is thus inclined relative to a plane orthogonal to the support 401. In a second step, shown in FIG. 10, mechanical force is applied onto the portion of the base 411 bearing down on the ends 405-1 of the locking tongues, so as to force this portion of the base 411 to be inserted into the housing 406, this portion then going under the tongues. In other words, the axis of revolution of the terminal lug 410 is tilted towards the housing 406 so as to be brought into a plane orthogonal to the support 401. The C-shape at the ends 405-1 of the locking tongues 405 can serve in particular to facilitate tilting the portion of the base 411 that initially bears down on the ends 405-1, so as to enable this portion of the base 411 to be guided under the locking tongues 405. Thereafter, the entire base 411 of the terminal lug 410 is inserted into the housing 406 and bears against the electrically conductive structure 450, thereby establishing electrical contact with that structure 450. After the terminal lug 410 has been inserted in the housing 406, the spring forces exerted by the shoe 404 and the locking tongues 405 on the base 411 then enable the terminal lug 410 to be maintained bearing against the electrically conductive structure 450, i.e. the electrical contact between the base 411 and the structure 450 to be locked.

Thus, the third above-described embodiment serves to guarantee electrical contact between the terminal lug 410 and the structure 450, merely by tilting the terminal lug 410 in the housing 406 and holding the terminal lug 410 by means of the shoe 404 and at least one locking tongues 405. This embodiment thus presents the advantage of enabling the terminal lug 410 to be assembled quickly and easily on the electrically conductive structure 450. This assembly does not require specific tools and fastener means, thereby avoiding any risk of conductive foreign bodies being present in the electrical connection device 400.

It should be observed that in all of the above-described embodiments, the terminal lugs 210, 310, and 410 present respective bases 211, 311, 411 of annular shape and their respective supports 201, 301, and 401 match the shapes of the bases in order to enable them to be assembled together. Nevertheless, the shape of these terminal lugs is not limiting, and by way of example the terminal lugs could present respective bases of any other shape (e.g. rectangular, triangular) and their respective supports could present shapes appropriate for enabling those faces to be assembled therewith while remaining very close to the embodiments as described.

Figure 11:
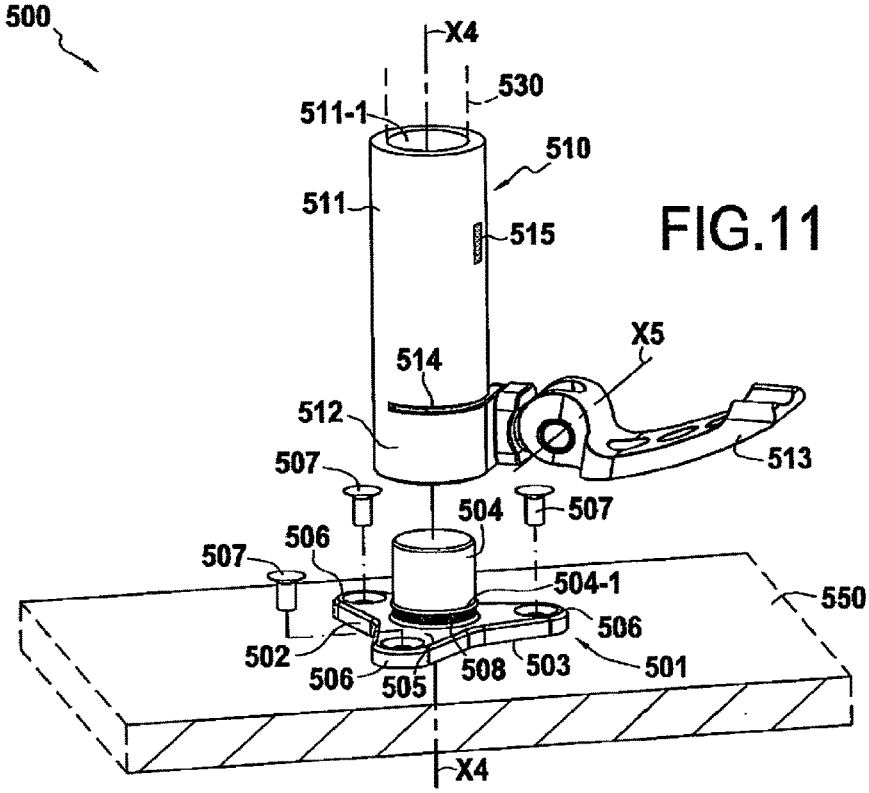
FIG. 11 is an exploded view of an electrical connection device in a fourth embodiment of the invention.
Figure 12:
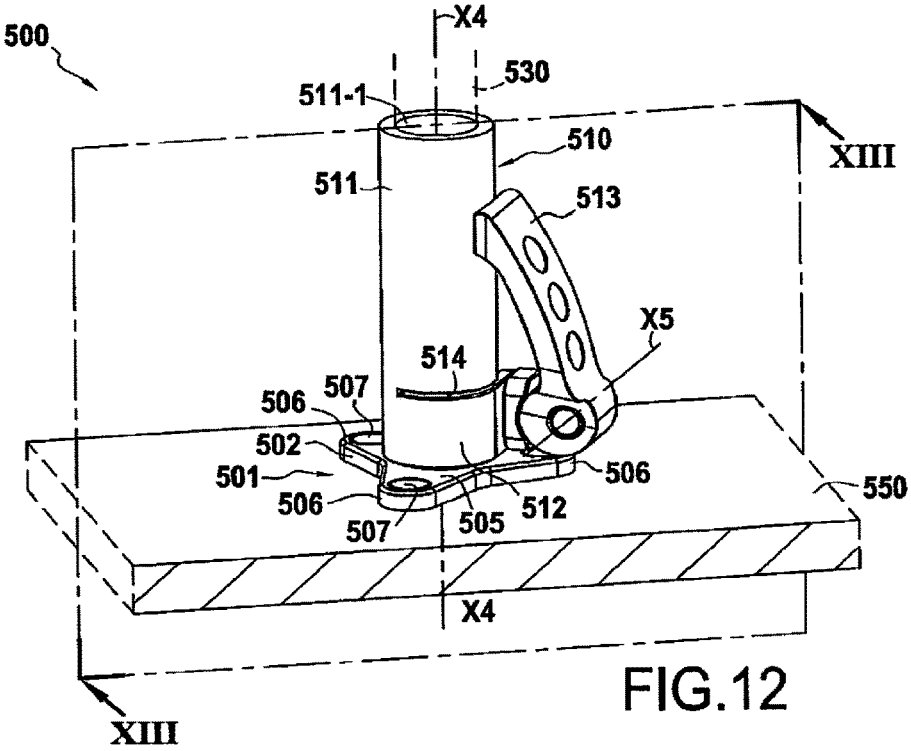
FIG. 12 is a perspective view of the FIG. 11 electrical connection device.
Figure 13:
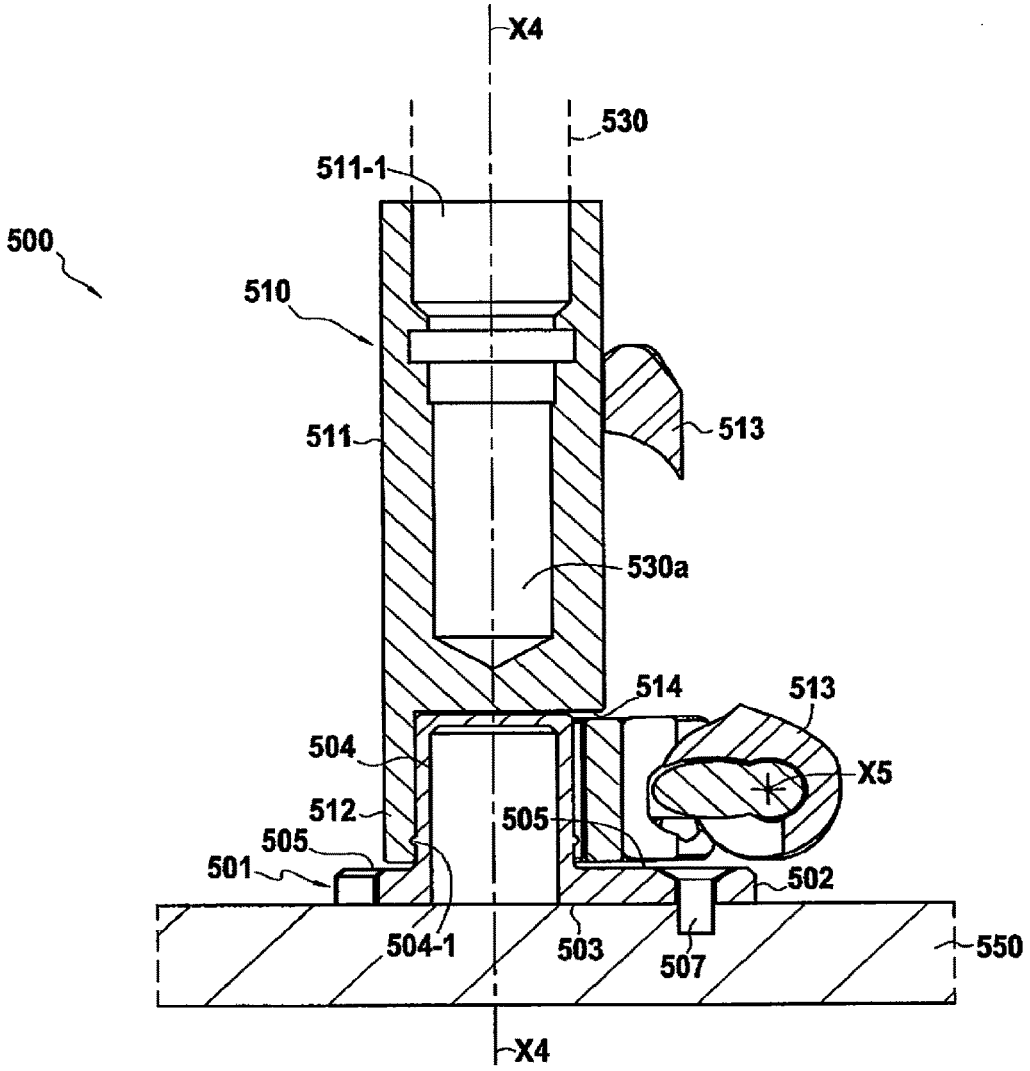
FIG. 13 is a section view of FIG. 12 on plane XIII-XIII.

FIGS. 11 to 13 show an electrical connection device 500 in a fourth embodiment of the invention. In the example shown, the device 500 is centered about an axis of X4 and is constituted by a support 501 and a terminal lug 510. The support 501 is for fastening on an electrically conductive structure 550, e.g. a metal surface of an aircraft.

Below, the term "bottom" is used to designate a face facing towards the structure 550, and the term "top" is used to designate a face facing away from the structure 550.

The support 501 has a plate 502 with a first face 502 (bottom face) that is to be in contact with the structure 550. An electrically conductive peg 504 projects from a second face 505 (top face) of the plate 502 opposite from its first face 503. As shown in FIG. 13, the peg 504 may be made as a hollow peg so as to reduce the weight of the support 501.

The plate 502 has fastener tabs 506. The support 501 is thus fastened on the structure 550 by using permanent fastener elements 507, e.g. using countersunk or round headed rivets passing through the tab 506 to be inserted in corresponding holes formed in the structure 550. In the example shown, the plate 505 has three fastener tabs 506 distributed around the peg 504. In this example, the plate 502 is in the form of a three-pointed star, each point comprising one tab 506. The surface area occupied by the plate 502 on the structure 550 is thus small, as is the weight of the support 501. Nevertheless, such an embodiment is not limiting, and the support 501 could present any other shape or any other number of fastener tabs 506.

The terminal lug 510 is electrically conductive and comprises an elastically deformable tubular shank 511 having one end 512 shaped to engage on the peg 504 of the support 501. In the example shown, the terminal lug 510 and the peg 504 are annular in shape. Nevertheless, the terminal lug 510 could present any other shape (e.g. oval, rectangular) and the peg 504 could be shaped correspondingly so as to enable the terminal lug 510 to be engaged on the support 501.

The terminal lug 510 also has an eccentric lever 513 associated with the tubular shank 511. The eccentric lever 513 is configured to be capable of exerting a clamping force on the tubular shank 511, more precisely on its end 512, so as to reduce its diameter compared with an initial diameter, the tubular shank 511 returning to its initial diameter in the absence of stress exerted by the lever. In order to enable its diameter to be reduced, the tubular shank 511 may optionally, but not necessarily, include one or more slots formed in its walls. By way of example, and in known manner, the tubular shank may have a T-shaped slot 514 extending circumferentially around the tubular shank 511, with only a portion of the slot being shown in this example. In the figures, the eccentric lever 513 can be turned about a pivot axis X5 perpendicular to the axis X4, the pivot axis X5 in another embodiment that is not shown possibly having any other direction, e.g. a direction parallel to the axis X4. In known manner, turning the eccentric lever 513 about the pivot axis X5 in a first direction serves to reduce the diameter of the tubular shank 511 by clamping it. The minimum diameter of the tubular shank 511 is then obtained when the lever comes into abutment against the tubular shank 511, this first configuration corresponding to a "closed" state of the lever. The tubular shank 511 is returned to an initial diameter by opposite turning of the eccentric lever 513 about the axis X5, i.e. in a direction opposite to the first turning direction, this second configuration corresponding to an "open" state of the eccentric lever 513.

As in the above embodiments, the tubular shank 511 of the terminal lug 510 enables the terminal lug 510 to be electrically connected to an electric cable 530 (shown in dashed lines) by inserting an end 530*a* of the electric cable 530 through a top orifice 511-1 of the tubular shank 511. Once more, the walls of the tubular shank 511 may be deformable so as to enable the electric cable 530 engaged in the tubular shank 511 to be held firm by crimping the walls.

When the support 501 is fastened on the electrically conductive structure 550 and an electric cable 530 is engaged in the terminal lug 510, electrical connection between the electric cable 530 and the electrically conductive structure 550 relies on the terminal lug 510 being put into electrical contact with the support 501. In this example, electrical contact is obtained by engaging the end 512 of the tubular shank 511 on the electrically conductive peg 504 of the support 501. The tubular shank 511 is engaged on the support 501 while the eccentric lever 513 is in an "open" state, in this example a lowered state as shown in FIG. 11. Once the end 512 of the tubular shank 511 has been engaged on the peg 504 of the support 501, the eccentric lever 513 is then turned to its "closed" state, in this example a raised position as shown in FIG. 12. Closing the lever reduces the diameter of the tubular shank 511, which is then clamped onto the peg 504, thereby enabling electrical contact between the terminal lug 510 and the support 501 to be locked. Furthermore, in order to improve the locking of the electrical contact of the tubular shank 511 against the electrically conductive peg 504, the peg 504 may include a bead 504-1 projecting outwards around its circumference.

Furthermore, the support 501 and the terminal lug 510 may each have visual indicators so that a person in charge of assembling them together can ensure that the electrical contact between the terminal lug 510 and the support 501 is properly locked. By way of example, the peg 504 may include a colored band 508 located circumferentially around its surface and the tubular shank 511 may include a pattern 515 on an outside face. Correct engagement of the end 512 of the tubular shank 511 on the peg 504 of the support 501 is then indicated by the band 508 being covered so that it is not longer visible. Likewise, proper closure of the eccentric lever 513 can be verified by the pattern 515 being covered by the eccentric lever 513, i.e. the pattern is no longer observable when the lever is in a locked state. The indicators not being observable thus serves to confirm that the electrical contact between the terminal lug 510 and the support 501 is properly locked. Conversely, the indicators being observable indicates that electrical contact between the terminal lug 510 and the support 501 is not locked.

Thus, the fourth above-described embodiment serves to provide good electrical contact between the terminal lug 510 and the support 501 merely by engaging the end 512 of the terminal lug 510 on the peg 504 of the support 501 and then turning the eccentric lever 513 to a closed state. Such an embodiment is particularly advantageous since it makes it possible to provide a terminal lug 510 that can be separated from the support 501, and that can be assembled thereto in simple and quick manner. Furthermore, such assembly does not require specific tools and fastener means, thereby avoiding any risk of conductive foreign bodies being present in the electrical connection device 500.

The invention claimed is:

1. An electrical connection device formed by assembling a support that is to be fastened on an electrically conductive structure together with an electrically conductive terminal lug that is to be electrically connected to an electric cable, wherein:

the support includes a first face that is to be in contact with said structure, with annular guide and locking channels projecting from a second face opposite from the first face, the channels extending in annular manner and defining a housing between them;

the terminal lug comprising an annular base for placing in the housing and a tubular shank fastened coaxially to the base, the base including a first face from which the tubular shank extends and a second face opposite from the first face and for being brought to bear against the second face of the support when the base is present in the housing;

the terminal lug further comprising a locking ring having the tubular shank passing through its center and movable in rotation relative to the tubular shank, the ring having annular ramps extending from the outer periphery of the ring, the annular ramps co-operating with the annular guide and locking channels of the support.

2. The electrical connection device according to claim 1, wherein each annular ramp of the locking ring includes a locking tooth that can be snap-fastened in a corresponding opening formed in an annular channel of the support, each opening being made in such a manner that at least one tooth of the ring, when snap-fastened in a corresponding opening, forms a visual indicator about a state of locking of the terminal lug against the support.

3. The electrical connection device according to claim 1, including a sealing O-ring surrounding an electrically conductive surface forming all or part of the second face of the base of the terminal lug.

4. The electrical connection device according to claim 1, including permanent fastener means configured to enable the support of the device, to be fastened to the electrically conductive structure.

5. An aircraft including an electrically conductive structure and at least one electrical connection device according to claim 1.

* * * * *